United States Patent [19]

Ohta et al.

[11] 4,157,219

[45] Jun. 5, 1979

[54] MULTI-COLOR ELECTRO-STATIC IMAGE LIQUID DEVELOPMENT APPARATUS

[75] Inventors: Tatsuo Ohta; Yoshiaki Harada, both of Hachioji, Japan

[73] Assignee: Konishiroku Photo Industry Co., Ltd., Tokyo, Japan

[21] Appl. No.: 809,918

[22] Filed: Jun. 24, 1977

[30] Foreign Application Priority Data

Jul. 10, 1976 [JP] Japan ..... 51-81475

[51] Int. Cl.[2] ..... G03G 15/10

[52] U.S. Cl. ..... 355/10; 118/645; 118/DIG. 23; 354/323; 355/4

[58] Field of Search ..... 355/10, 4, 3 SC; 354/323; 118/645, DIG. 23; 425/15-17

[56] References Cited

U.S. PATENT DOCUMENTS 3,467,468 9/1969 Johnson ..... 355/4

*Primary Examiner*—R. L. Moses

*Attorney, Agent, or Firm*—Lane, Aitken & Ziems

[57] ABSTRACT

A liquid development apparatus for developing electrostatic latent images borne on the surface of an image bearing medium. The apparatus comprises leading and trailing squeeze rollers in horizontally spaced relation, means disposed between the squeeze rollers and spaced apart from the surface a short distance for selectively and uniformly applying a plurality of liquid developers and a rinse liquid to the surface, and means disposed at the rear side of the trailing squeeze roller for neutralizing or dissipating the residual charge remaining on the surface after development. These components are all mounted to a carriage adapted for reciprocation relative to the surface so that the electrostatic latent image is successively subject to developing, squeezing, and charging in this order during the movement of the carriage in the forward direction, and it is subject to rinsing during the movement of the carriage in the rearward direction. Such movement is repeated desired times to make a multi-colored print.

8 Claims, 8 Drawing Figures

MULTI-COLOR ELECTRO-STATIC IMAGE LIQUID DEVELOPMENT APPARATUS

BACKGROUND OF THE INVENTION

The invention relates to a liquid development apparatus for use in electrophotographic printing machines and, more particularly, to improvements in a liquid development apparatus for successively applying a plurality of liquid developers to the surface of an image bearing medium to render visible the electrostatic latent image produced on the image bearing surface.

In the field of electrophotography, the development of an electrostatic latent image on the surface of an image bearing medium can be accomplished by a process referred to as "Liquid development", in which a developer comprising charged toner particles dispersed in an insulating liquid is applied to the surface of the image bearing medium to render visible the electrostatic latent image thereon.

It has been proposed to provide apparatus for successively applying a plurality of liquid developers to the surface of an image bearing medium on which an electrostatic latent image is proviously produced in the electrophotographic printing art to make a multi-colored print. However, such conventional apparatus do not fully meet higher speed and miniaturization requirements demanded in today's marketplace.

SUMMARY OF THE INVENTION

It is an object of the present invention to provide a liquid development apparatus for rapidly developing electrostatic latent images.

Another object of the present invention is to provide a high speed liquid development apparatus which produces high quality prints.

Still another object of the invention is to provide a miniaturized liquid development apparatus which is inexpensive to produce.

Briefly stated, in accordance with the present invention, there is provided an improved liquid development apparatus for developing electrostatic latent images borne on the surface of an image bearing medium which comprises leading and trailing squeeze rollers arranged in horizontally spaced relation and in contact with the surface, means disposed between the squeeze rollers and spaced apart from the image bearing surface a short distance for selectively applying a plurality of liquid developers and a rinse liquid to the surface, and means disposed at the rear side of the trailing squeeze roller for neutralizing or dissipating the residual charge remaining on the surface. One of the features of the present invention is that these components are all mounted to a carriage adapted for reciprocation relative to the surface so that the electrostatic latent image is successively subject to developing, squeezing, and charging in this order during the movement of the carriage in the forward direction and it is subject to rinsing during the movement of the carriage in the rearward direction. Such reciprocation is repeated desired times to make a multicolored print.

The liquid applying means includes a receptacle having therein a developing electrode spaced apart from the image bearing surface a predetermined distance and a liquid flow regulating plate for uniformly applying the liquid developers and the rinse liquid to the surface, and conduit means having a plurality of pipes connected to the receptacle for selectively supplying the liquid developers and the rinse liquid.

In a preferred embodiment of the improved liquid development apparatus, the movable carriage carries leading, intermediate, and trailing squeeze rollers, two liquid applying means of the type similar to that described above, one disposed between the leading and intermediate squeeze rollers and the other disposed between the intermediate and trailing squeeze rollers, and two corona charging means disposed at the front side of the leading squeeze roller and at the rear side of the trailing squeeze roller so that the image bearing surface is successively subject to charging, developing, squeezing, rinsing, and charging in this order during the movement of the carriage in one direction.

Other objects and advantages of the present invention will become more apparent from the detailed description of the preferred embodiments which follows.

BRIEF DESCRIPTION OF THE DRAWINGS

In the detailed description of the preferred embodiments presented below, reference is made to the accompanying drawings wherein like parts are designated by like reference numerals while similar parts having identical functions are designated by the same reference numerals with a prime suffix and in which.

DESCRIPTION OF THE PREFERRED EMBODIMENTS

Figure 1A:
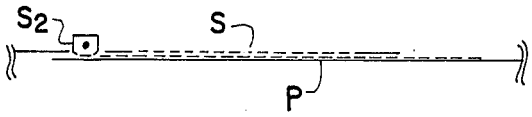
FIG. 1A is a fragmentary schematic view of a portion of the electro-photographic printing machine illustrated in FIG. 1 showing a screen brought down over a recording medium.
Figure 1:
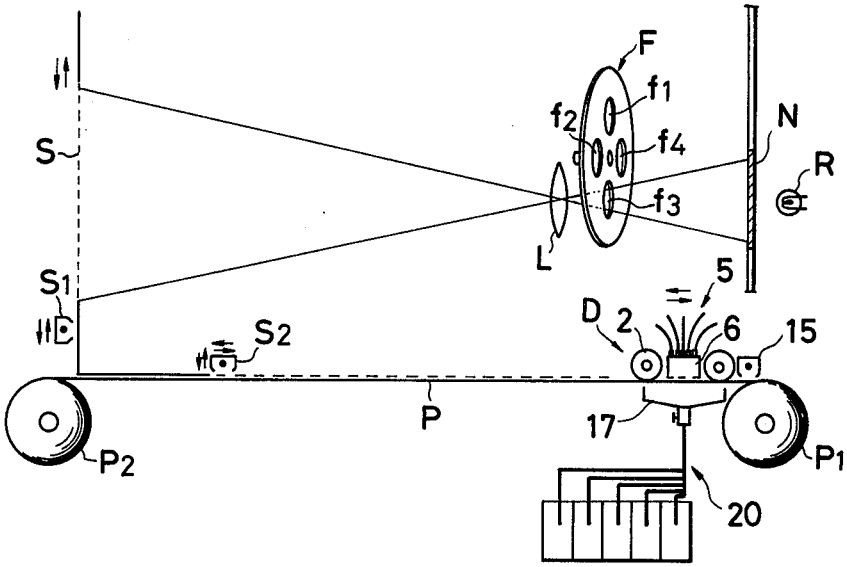
FIG. 1 is a schematic view of an electrophotographic printing machine including a liquid development apparatus in accordance with the first embodiment of the present invention.

For a general understanding of the illustrated electrophotographic printing machine adapted to reproduce multi-color prints from a colored original document in which the invention may be incorporated, reference is initially made to FIG. 1. The printing machine utilizes a photoconductive screen S and a first charge device S1 which has a corona discharge electrode and is adapted for vertical movement over the screen S to uniformly charge and make the same photosensitive. The printing machine also includes an illumination system such as a lamp R for illuminating a colored original document N to produce the light pattern thereof. The light pattern is projected onto the surface of the photosensitive screen S by means of an optical system having a filter mechanism F and a lens L thereby producing thereon an electrostatic latent image in conformity with the light pattern. The filter mechanism F is comprised of a rotary plate provided with red, green, blue, and neutral filters f1 through f4 for interposing the selective filters into the optical light path of the lens L.

The screen S on the surface of which an electrostatic latent image is produced is brought down into close contact with an electrostatic recording medium P (FIG. 1A) stretched between a supply roller P1 and a take-up roller P2. A second charge device S2 is then travelled over the screen S to produce an electrostatic latent image on the electrostatic recording medium P and thereafter the screen S is returned to the initial position. The electrostatic latent image on the electrostatic recording medium P is then developed by means of a liquid development apparatus D according to the present invention.

Figure 2:
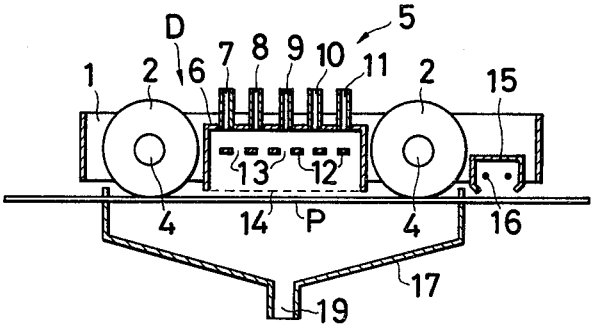
FIG. 2 is an enlarged schematic view of the detail of the liquid development apparatus of FIG. 1.
Figure 3:
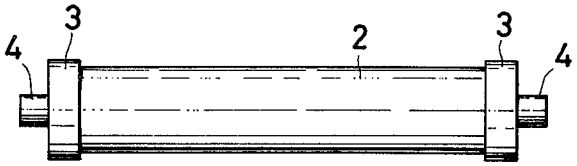
FIG. 3 is an elevational view showing a squeeze roller used in the liquid development apparatus of the present invention.

Referring particularly to FIG. 2, there is illustrated in detail the liquid development apparatus D of the present invention which comprises a carriage 1 and leading and trailing squeeze rollers 2. As best shown in FIG. 3, the squeeze rollers have their shafts 4 rotatably mounted to the carriage 1 and have at each of their opposite ends outwardly protruding flanges 3 which function as drive wheels running along rails (not shown) disposed in the opposite sides of the electrostatic recording medium P, thereby permitting the movement of the carriage 1 over the electrostatic recording medium P. The liquid development apparatus D also comprises liquid applying means 5 including a receptacle 6 and conduit means having a plurality of flexible valved pipes 7 through 11 connected to respective liquid tanks and opened to the receptacle 6 for successively supplying into the receptacle 6 liquid developers such as, for example, yellow, magenta, cyan, and black liquid developers and a rinse liquid. The receptacle 6 is provided with a liquid flow regulating plate having a number of holes 13 and at its lower portion a development electrode 14 such as a metal screen electrode spaced away from the surface of the electrostatic recording medium P a short distance for uniformly applying the liquids to the surface.

Mounted to the carriage 1 at the rear side of the trailing squeeze roller 2 is an electrostatic corona charging device 15 having corona discharge electrode 16 for neutralizing or dissipating the residual charge remaining on the electrostatic recording medium surface after development. The liquid development apparatus is shown as having a funnel 17 disposed under the receptacle 6 for receiving the used liquid developers and rinse liquid and introducing them into respective liquid tanks through flexible pipes 20 connected to the valved port 19 of the funnel 17.

The operation of the development apparatus will now be described in connection with the production of a multi-color print.

In the first process, the blue filter f3 is interposed in the optical light path of the lens L through which the light image of the original document N is projected onto the photoconductive screen S whose surface is made photosensitive by a previous step of uniformly charging by means of the first charge device S1 to produce thereon an electrostatic latent image. The image bearing screen S is then brought down into contact with the electrostatic recording medium P and is subject to uniform charging by means of the second charge device S2 to produce an electrostatic latent image on the recording medium surface.

When the development apparatus D is in the position illustrated in FIG. 1, the yellow liquid developer is supplied through the pipe 7 into the receptacle 6 and at the same time the development electrode 14 and the corona charging device 15 are placed in the operable state. During the movement of the development apparatus D to the left up to predetermined position, the electrostatic latent image on the recording medium surface is successively subject to developing, squeezing, and charging in this order. During development, the yellow liquid developer is uniformly applied to the electrostatic latent image by the function of the metal screen electrode 14 and the liquid flow regulating plate 12. The used yellow liquid developer is received by the funnel 17 and introduced from the port 19 into the tank through the pipe 20.

After the development apparatus reaches the predetermined position, the receptacle 6 is supplied with the rinse liquid through the pipe 11 and then the development apparatus D is moved to the right up to the initial position with the rinse liquid applied uniformly to the recording medium surface to clean the yellow liquid developer remaining in the receptacle 6 and on the non-image area of the recording medium surface. During rinsing, the rinse liquid is uniformly applied to the recording medium surface by the function of the liquid flow regulating plate 12 and is received by the funnel 17 and introduced from the port 19 into the tank through the pipe 20.

After the first process is completed, the second process is procedured. The second process is substantially the same as described in the first process except that the green filter f2 is interposed in the optical light path of the lens L and that the receptacle 6 is supplied with the magenta liquid developer through the pipe 8 when the development apparatus is placed in the initial position. Such process is repeated desired times corresponding to the colors required to make a multi-color print. It is to be understood, of course, that a white-black print may be obtained in such a development apparatus by the use of black liquid developer.

Figure 4:
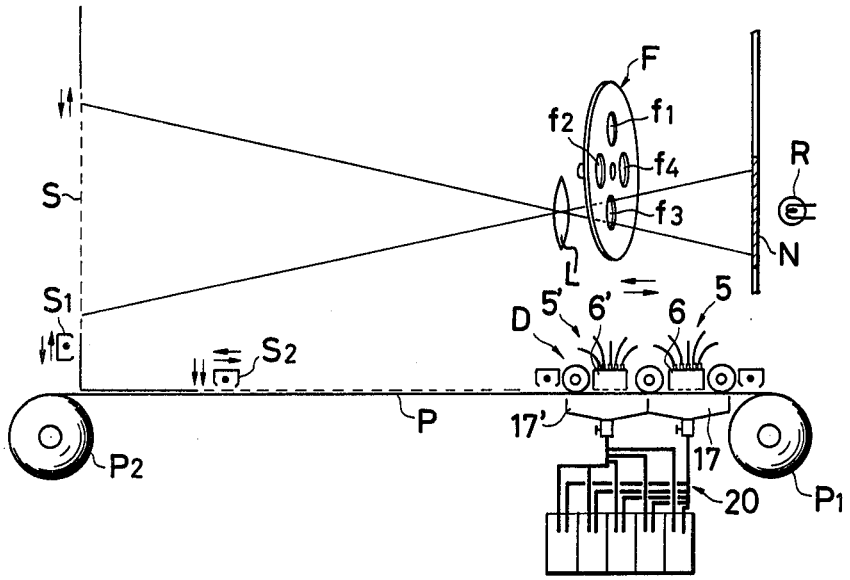
FIG. 4 is a schematic sectional view showing a second embodiment of a liquid development apparatus incorporated in the electrophotographic printing machine.
Figure 5:
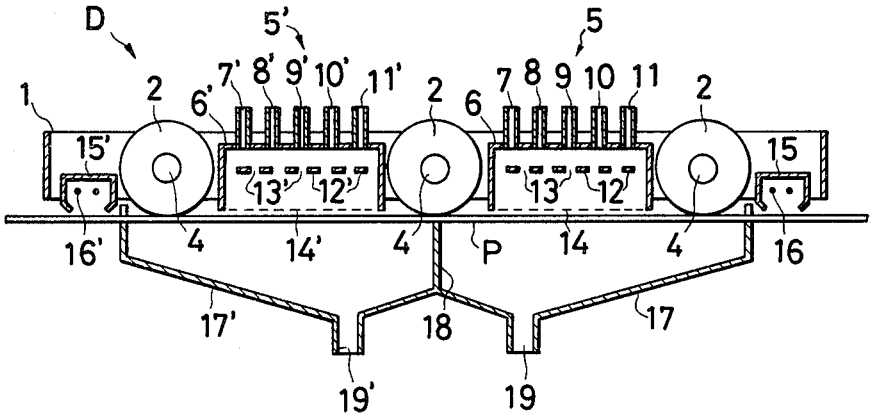
FIG. 5 is an enlarged schematic view of the detail of the liquid development apparatus of FIG. 4.

Reference is now made to FIGS. 4 and 5, wherein is shown a second embodiment of a liquid development apparatus according to the present invention. As in FIG. 1, the illumination system is designated R, the colored original document N, and the lens L. The filter mechanism having a rotary plate provided with the red, green, blue, and neutral filters f1 through f4 is designated F, the photoconductive screen S and the first charge device S1. The electrostatic recording medium stretched between the supply roller P1 and the take-up roller P2 is designated P, the second charge device S2, and the development apparatus D.

Referring particularly to FIG. 5, there is illustrated in detail the liquid development apparatus D in accordance with the second embodiment of the present invention. The development apparatus comprises a carriage 1 and leading, intermediate, and trailing squeeze rollers 2 having their shafts 4 rotatably mounted to the carriage 1 in horizontally spaced relation and having at each of their opposite ends outwardly protruding flanges 3 which function as drive wheels running along rails (not shown) disposed in the opposite sides of the electrostatic recording medium P, thereby permitting the movement of the carriage 1 over the electrostatic recording medium surface. Mounted to the carriage 1 between the leading and intermediate squeeze rollers is first liquid applying means 5' and mounted to the carriage 1 between the intermediate and trailing squeeze rollers is second liquid applying means 5. The first and second liquid applying means 5' and 5 are equal in construction to each other and each has a receptacle 6' or 6 and conduit means having a plurality of flexible valved pipes 7' through 11' or 7 through 11 connected to respective liquid tanks and opened to the receptacle 6' or 6 for successively supplying into the receptacle 6' or 6 liquid developers such as, for example, yellow, magenta, cyan, and black liquid developers and a rinse liquid. The receptacle 6' and 6 each is provided with a liquid flow regulating plate 12' or 12 having a number of holes 13' and 13 and at its lower portion a development electrode 14' or 14 such as a metal screen electrode spaced away from the surface of the electrostatic recording medium P a short distance for uniformly applying the liquid to the surface.

Mounted to the carriage 1 at the front side of the leading squeeze roller 2 and at the rear side of the trailing squeeze roller 2 are first and second corona charging devices 15' and 15 each having corona discharge electrodes 16' or 16 for neutralizing or dissipating the residual charge remaining on the recording medium surface after development. In addition, the liquid development apparatus D has funnels 17' and 17 under the respective receptacle 6' and 6 for receiving the used liquids and introducing them into respective liquid tanks through flexible pipes 20' and 20 connected to the valved ports 19' and 19 of the funnels 17' and 17.

The operation of the development apparatus in this embodiment will now be described in connection with the production of a multi-color print.

In the first process, the blue filter f3 is interposed in the optical light path of the lens L through which the light pattern of the original document N is projected onto the photoconductive screen S whose surface is made photosensitive by a previous step of uniformly charging by means of the first charge device S1 to produce thereon an electrostatic latent image. The image bearing screen S is then brought down into contact with the electrostatic recording medium P and is subject to uniform charging by means of the second charge device S2 to produce an electrostatic latent image on the recording medium surface.

When the development apparatus D is in the position illustrated in FIG. 4, the yellow liquid developer is supplied through the pipe 7' into the receptacle 6' and the rinse liquid is supplied through the pipe 11 into the receptacle 6 and at the same time the development electrode 14' and the corona charging device 15 are placed in the operable state. During the movement of the development apparatus D to the left up to a predetermined position, the electrostatic latent image on the recording medium surface is successively subject to developing, squeezing, rinsing, squeezing, and charging in this order. The used yellow liquid developer and rinse liquid are received by the funnels 17' and 17 and introduced from the port 19' and 19 into the tanks through the pipes 20' and 20, respectively.

After the first process is completed, the second process is procedured. The second process is substantially the same as described in the first process except that the green filter f2 is interposed in the optical light path of the lens L and that the receptacle 6 is supplied with the magenta liquid developer through the pipe 8 and the receptacle 6' is supplied with the rinse liquid through the pipe 11' and the corona charging device 15' is placed in the operable state instead of the corona charging device 15. Such process is repeated desired times corresponding to the colors required to make a multicolor print.

Figure 6:
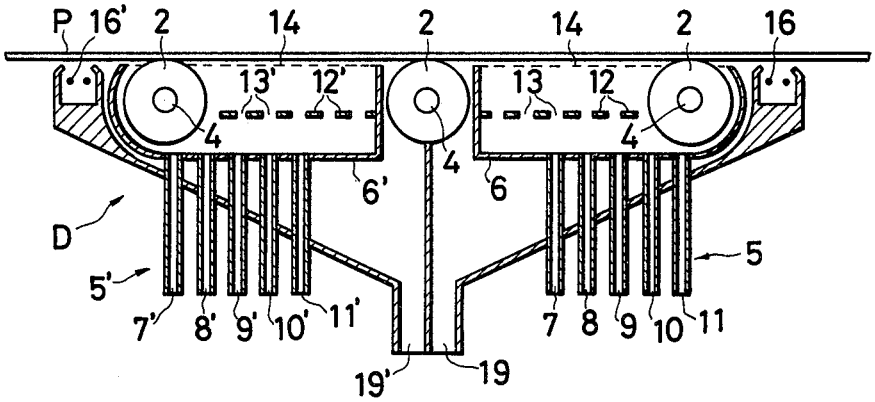
FIG. 6 is a schematic sectional view showing a third embodiment of a liquid development apparatus in accordance with the present invention.

FIG. 6 illustrates a third embodiment of a liquid development apparatus in accordance with the present invention. The chief difference between the FIG. 6 embodiment and the second described embodiment is that an electrostatic latent image is produced on the lower surface of the electrostatic recording medium P and is developed by the development apparatus running under the electrostatic recording medium surface. The structure and operation of the liquid development apparatus in this embodiment is similar to that described in connection with FIG. 5 and hence a detailed description will be omitted.

Figure 7:
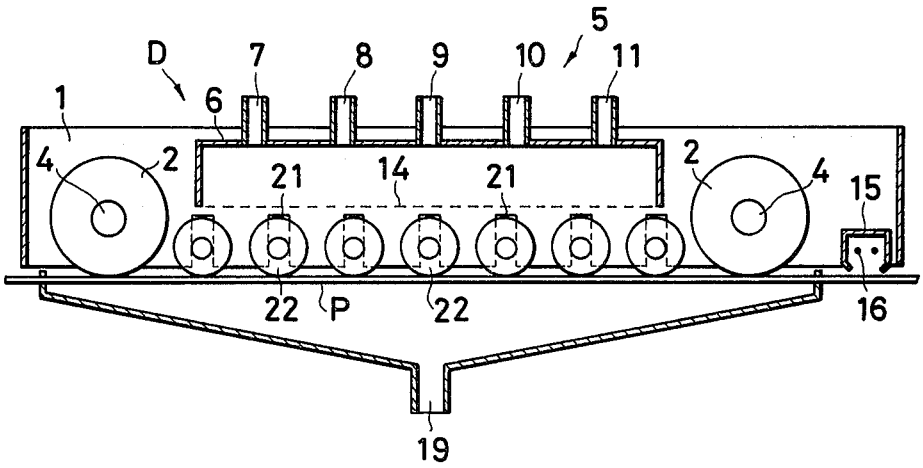
FIG. 7 is a schematic sectional view showing a fourth embodiment of a liquid development apparatus in accordance with the present invention.

FIG. 7 illustrates a fourth embodiment of a liquid development apparatus in accordance with the present invention. The chief difference between the FIG. 7 embodiment and the first described embodiment is that a plurality of metal rollers 22 are used as developing electrode means in place of the metal screen electrode 14 of FIG. 2. The operation of the development apparatus in this embodiment is similar to that described in connection with FIG. 2 and hence a detailed description will be omitted except for the arrangement of the metal roller electrode 22. In order to facilitate application of a bias voltage to the metal roller electrode 22 and to prevent the occurrence of smears, the metal roller development electrode 22 is coated at each of its opposite ends with an insulating material to form a slightly larger diameter portion which is disposed on the rail and rotated by the movement of the carriage 1 and is slidably supported by vertical grooves and spring biased toward the recording medium P.

It is to be understood, of course, that a plurality of development apparatus may be used when needed.

The liquid development apparatus in accordance with the first and fourth described embodiments can provide the following advantages:

First, such an arrangement that a rinse liquid is supplied into the receptacle after a liquid developer is supplied thereinto permits a single receptacle to be used commonly for various liquid developers without their mixing and permits the image bearing medium surface to be fully rinsed. This provides a high quality print.

Second, such an arrangement that the receptacle, two squeeze rollers, and a corona charging device are compactly mounted to a carriage adapted for movement over the image bearing surface permits to miniaturize the liquid development apparatus.

Third, such an arrangement that the receptacle has a development electrode as well as a liquid flow regulating plate permits the liquid developers and the rinse liquid to be applied uniformly to the image bearing surface, resulting in a high quality print.

Fourth, such an arrangement that the residual charge remaining on the image bearing surface is neutralized or dissipated immediately after development can provide a high speed development apparatus.

In addition to the above mentioned advantages, the liquid development apparatus in accordance with the second and third described embodiments can provide the following advantage:

Fifth, such an arrangement that developing and rinsing are successively accomplished for a short time during the liquid development apparatus moving in one direction can provide a high speed liquid development apparatus.

It is, therefore, apparent that there has been provided, in accordance with this invention, a miniaturized liquid development apparatus which can produce high quality prints at a high development rate that fully satisfies the objects and advantages set forth above. While this invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A liquid development apparatus for developing an electro-static latent image previously formed on the surface of an image support, said apparatus comprising:

a carriage horizontally reciprocable relative to the surface;

means for applying a plurality of liquid developers and a rinse liquid mounted to the carriage;

leading and trailing rollers rotatably mounted to both sides of the carriage and in contact with the surface for squeezing the same; which pair of rollers cooperatively define a liquid receiving area on the surface therebetween;

a liquid flow regulating plate mounted to the carriage and positioned under the liquid applying means for dispersing a selectively supplied liquid; and a development electrode located under the liquid regulating plate and movable with the carriage;

whereby an electro-static latent image is successively subjected to developing and squeezing during the movement of the carriage in one direction and it is subjected to rinsing during the movement of the carriage in the opposite direction.

2. A liquid development apparatus as set forth in claim 1, wherein said developing electrode comprises a metal screen electrode.

3. A liquid development apparatus as set forth in claim 1, wherein said development electrode comprises a plurality of metal roller electrodes.

4. A liquid development apparatus as set forth in claim 1, wherein said carriage is adapted for horizontal movement over said surface.

5. A liquid development apparatus as set forth in claim 1, wherein said carriage is adapted for horizontal movement under said surface.

6. A liquid development apparatus for developing electrostatic latent images borne on the surface of an image bearing medium, said apparatus comprising: a carriage adapted for horizontal movement relative to said surface; leading, intermediate, and trailing rollers rotatably mounted to said carriage in horizontally spaced relation and in contact with said surface for squeezing the same; two liquid applying means mounted to said carriage between said leading and intermediate rollers and between said intermediate and trailing rollers in slightly spaced relation to said surface for selectively and uniformly applying a plurality of liquid developers and a rinse liquid to said surface; and two corona charging means mounted to said carriage at the front side of said leading roller and at the rear side of said trailing roller for neutralizing or dissipating the residual charge remaining on said surface after development; whereby said electrostatic latent image is successively subject to developing, squeezing, rinsing, squeezing, and charging in this order during the movement of the carriage in one direction.

7. A liquid development apparatus as set forth in claim 6, wherein said carriage is adapted for horizontal movement over said surface.

8. A liquid development apparatus as set forth in claim 6, wherein said carriage is adapted for horizontal movement under said surface.

* * * * *